US005443397A

United States Patent [19]

Carl

[11] Patent Number: 5,443,397

[45] Date of Patent: Aug. 22, 1995

[54] ELECTRIC CONNECTOR PLUG RETAINER

[76] Inventor: John L. Carl, 3301 Hanlan Rd., Millington, Mich. 48746

[21] Appl. No.: 202,356

[22] Filed: Feb. 28, 1994

[51] Int. Cl.[6] ..... H01R 13/62

[52] U.S. Cl. ..... 439/369; 439/370

[58] Field of Search ..... 439/367, 368, 369, 370, 439/345, 350

[56] References Cited

U.S. PATENT DOCUMENTS

| | | | |
|---|---|---|---|
| D. 340,695 | 10/1993 | Merriman et al. . | |
| 4,643,505 | 2/1987 | House et al. | 439/369 |
| 4,784,612 | 11/1988 | Ryan | 439/367 |
| 4,940,424 | 7/1990 | Odbert | 439/369 |
| 5,052,939 | 10/1991 | Koch | 439/133 |
| 5,211,573 | 5/1993 | Cross | 439/369 |
| 5,259,782 | 11/1993 | Giffin | 439/367 |
| 5,334,042 | 8/1994 | Chevalier | 439/369 |

FOREIGN PATENT DOCUMENTS 2605810 4/1988 France .

*Primary Examiner*—Khiem Nguyen

*Attorney, Agent, or Firm*—Learman & McCulloch

[57] ABSTRACT

The electric connector plug retainer (10) holds a male electric plug (12) in engagement with a female electric plug (14). The electric connector plug retainer (10) includes a first ring section (40) with a central aperture (48) for the passage of an electric cable (16) and a second ring section (42) for the passage of an electric cable (18). Elongated elastic members (44 and 46) are integral with the first and second ring sections (40 and 42), bias the first and second ring sections toward each other and bias the electric plug (12) and the electric plug (14) toward each other to retain an electric connection. A slit (52) is provided in the second ring section for the passage of a cable (18) into and out of the central aperture (50). Tabs (54) are provided in the slit (52) to restrict the passage of a cable through the slit. A slit (68) can be provided in the first ring section (40) if desired.

10 Claims, 1 Drawing Sheet

ELECTRIC CONNECTOR PLUG RETAINER

BACKGROUND OF THE INVENTION

FIELD OF THE INVENTION

This invention relates to an electric connector plug retainer and more particularly to a resilient retainer that exerts a force due to its elasticity which holds male and female electrical connectors in engagement.

PRIOR ART

Portable hand tools that are electrically powered have become common in recent years. Today, a large variety of electric powered hand tools are in use. These tools generally have a relatively short electric cord with an electric plug having two male flat blade post-type electric terminals and a round post ground terminal. There are also electric plugs having three male flat blade terminals for power hand tools that require two phase electric power. In some geographic areas the male electric plugs have two or three round posts for male terminals. A fixed receptacle for receiving the terminals of a male electric plug is often too far from the site where an electric hand tool is to be used for the electric cord that is integral with the powered hand tool to reach. In these situations, an extension cord is required.

Extension cords have a male electric plug on one end and a female electric plug on the other end. The male electric plug is inserted into a fixed receptacle or into the female electric plug on another extension cord. The female electric plug of the extension cord receives the male electric plug of an electric powered hand tool. The connection between the male electric plug on the electric powered hand tool and the female electric plug on an extension cord is normally maintained by friction. Frequently, the frictional force to maintain a connection between male and female electric plugs is insufficient and the male electric plug disengages from the female electric plug. Such disconnections are particularly aggravating when the power tool is being used in a hard to reach place. If the user of an electrically powered tool has to negotiate a ladder or crawl into a confined space, it will take substantial time and effort to reconnect a male electric plug with a female electric plug. A disconnection between a male and a female electric plug may also subject the user of a hand tool to danger.

Many procedures and devices have been employed to maintain electrical connections between male and female electric plugs. Two electric cords have been tied to each other so that the tension forces between the two cords do not pass through the male and female electric plugs. Tying electric cords together frequently damages the insulation coverings and reduces their useful life. Some devices that have been used to retain engagement between male and female electric plugs also damage insulation coverings and reduces the useful life of the electric cords.

Male and female electric plugs are manufactured with various diameters and lengths. There are standards which control the size, spacing, and arrangement of the posts and the post receptacles in electric plugs. There are no acceptable standards which control the length, diameter and shape of male or female electric plugs on extension cords and power tools. Electric connector plug retainers are available that are designed to accommodate and retain engagement between male and female electric plugs with a range of lengths and a range of outside diameters and shapes. These electric connector plug retainers have many limitations and drawbacks. They generally have numerous parts, some of which can be lost or broken. The electric connector plug retainers may require time consuming assembly or adjustment. Current electric connector plug retainers are also generally large and bulky to accommodate large male and female electric plugs. The currently available electric connector plug retainers all tend to be expensive to purchase and to use.

SUMMARY OF THE INVENTION

An object of the invention is to provide a one piece electric connector plug retainer for maintaining engagement between male terminals and female terminal receptacles of electric plugs.

Another object of the invention is to provide an electric connector plug retainer that is resilient and biases male electric plugs into full engagement with female electric plugs.

A further object of the invention is to provide an electric connector plug retainer that accommodates plugs with a range of lengths, diameters, and shapes.

The electric connector plug retainer of this invention is a single piece with two ring sections connected to each other by one or more integral elongated elastic members. One of the ring sections has an aperture that a cord of a power tool or an extension cord passes through and with the electric plug positioned between the two ring sections. The other ring section has an aperture and a slit running the length of the aperture that permits an electric cord with another electric plug to be manually pressed through the slit and into the aperture when the male and female electric plugs are in electrical engagement with each other. The elongated elastic members pass along the sides of the two electric plugs and bias the electric plugs toward each other. The elongated elastic members can conform to the size and shape of the two electric plugs and accommodate a substantial range of electrical plug lengths, diameters, and shapes.

Male and female electric plugs are normally fully engaged with each other first and then the elongated elastic members are stretched around the two engaged plugs and the cord on one plug is manually pressed through a slit and into the aperture through one of the ring sections. To disengage a male electric plug from a female electric plug, a cord is pulled out of the aperture through the slit in one of the ring sections releasing the two electric plugs which are then pulled apart in the normal manner. The electric connector plug retainer remains connected to the electrical cord which passes through an aperture through a ring section without a slit. Slits can be provided in both ring sections if so desired to allow the electric plug retainer to be moved to other electric plugs.

To accommodate very small electric plugs or very large electric plugs, electric connector plug retainers can be made in various sizes each of which would accommodate a range of electric plug dimensions. The elongated elastic members of electric connector plug retainers can be manufactured with various cross-sectional areas to provide the required force to maintain engagement between two electric plugs.

The foregoing and other objects, features, and advantages of the present invention will become apparent in light of the following detailed description of an exemplary embodiment thereof as illustrated in the accompanying drawings.

DESCRIPTION OF THE PREFERRED EMBODIMENT

Figure 1:
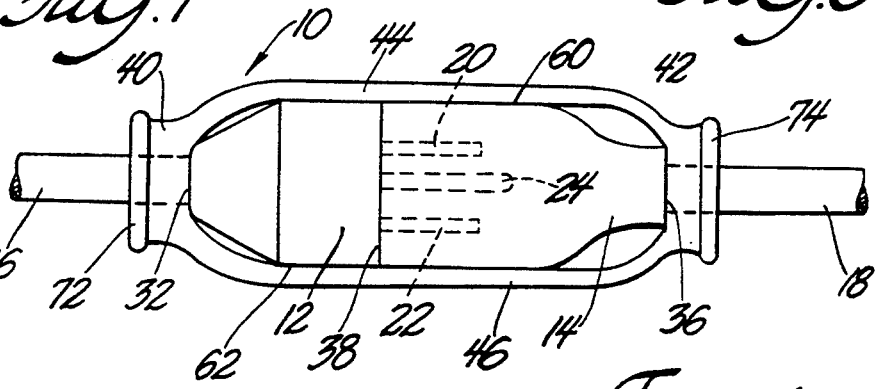
FIG. 1 is a plan view of the electric connector plug retainer and engaged and retained electric plugs.

The electric connector plug retainer 10 for maintaining a connection between a cooperating male electric plug 12 on an electric cable 16 and a female plug 14 on an electric cable 18 is shown in FIG. 1. The electric connector plug retainer 10 is as shown a molded unitary member made from a resin with high elasticity such as thermoplastic rubber.

A standard male electric plug 12 for 120 volts has two spaced apart blade-type terminals 20 and 22 and a ground terminal 24. The ground terminal 24 is a round rod or post. The female plug 14 has terminal receptacles 26, 28, and 30 that receive and grip the terminals 20, 22, and 24 to make a connection that transmits current. Male and female electric plugs can take many forms, however. Some have all cylindrical terminals and corresponding terminal receptacles. Male plugs 12 for two phase electric current generally have three blade-type terminals with various spacings and terminal orientations relative to each other.

The cable-16 enters the male electric plug 12 through a rear wall 32. The terminals 20, 22, and 24 of the male electric plug 12 extend from a front wall 34. The distance between the rear wall 32 and the front wall 34 is the effective length of the male electric plug 12. The cable 18 enters the female electric plug 14 through a rear wall 36. The terminal receptacles 26, 28, and 30 are inside the female electric plug 14 between the rear wall 36 and the front wall 38. The distance between the rear wall 36 and the front wall 38 of the female electric plug 14 is the effective length of the female electric plug. The diameter and shape of the cables 16 and 18 varies substantially depending upon the voltage and current capacity and the insulation covering employed. The effective length, the outside diameter and the shape of both the male plug 12 and the female plug 16 varies substantially from one plug unit to another.

Friction between the male blade-type terminals 20, 22, and 24 and the female terminal receptacles 26, 28, and 30 is generally relied upon to maintain engagement between male electric plugs 12 and female electric plugs 14. Unfortunately, the frictional forces are not readily controllable. If the friction forces are too high, it can be very difficult to force the male terminals 20, 22 and 24 into the female terminal receptacles 26, 28 and 30. The frictional forces tend to decrease with repeated engagement and disengagement between male and female electric plugs 12 and 14. Worn male and female electric plugs may provide very small frictional force and become disengaged with a slight tension force on the cables 16 and 18. When the cable 16 is attached to a tool that is moved from work site to work site, the force required to drag the cable 18 frequently exceeds the frictional force between the male electric plug 12 and the female electric plug 14 and disengage the plugs from each other.

The electric connector plug retainer 10 has a first ring section 40 and a second ring section 42. The two ring sections 40 and 42 are connected to each other by two integral elongated elastic members 44 and 46. The entire electric connector plug retainer 10 is preferably molded from one thermoplastic rubber resin. The ring sections 40 and 42 have a relatively large cross sectional area so that they are relatively stiff and must be subjected to a substantial force to be deformed. The elongated elastic members 44 and 46 have a relatively small cross sectional area so that they can be stretched and increased in length. A cross sectional area of the elongated elastic members 44 and 46 is chosen that will provide the required elastic force to hold male and female electric plugs 12 and 14 in engagement, accommodate variations in the size of male and female electric plugs, and allow release of the electric connector plug retainer.

The first ring section 40 has a central aperture 48 that is large enough for passage of a cable 16 and small enough to prevent the passage of the male electric plug 12. The aperture 48 can accommodate some variations in the diameter of the cable 16. The cable 16 is preferably inserted through the aperture 48 and then attached to a hand tool with fasteners. The electric connector plug retainer 10 is thereby retained on the cable 16 of a power hand tool.

The second ring section 42 has a central aperture 50 for the passage of a cable 18. A slit 52 is provided through one side of the ring section 42 for the lateral passage of the cable 18 into the aperture 50. The slit 52 has sufficient width to allow a cable to be manually forced through the slit 42 and into or out of the central aperture 50. Tabs 54 are provided on the walls of the slit 52 to facilitate passage of the cable 18 through the slit 52 in response to a manual force and to prevent unintentional passage of the cable through the slit.

Figure 2:
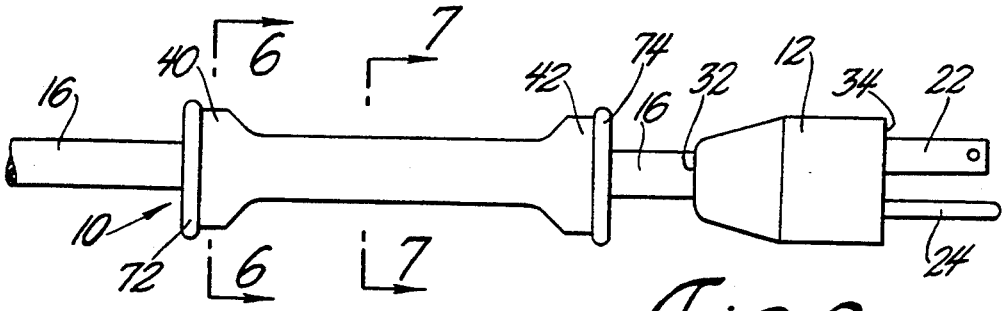
FIG. 2 is an elevation view of the electric connector plug retainer in a storage position on one electric cable.
Figure 3:
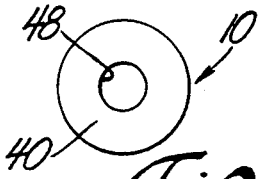
FIG. 3 is an end view of one end of the electric connector plug retainer.
Figure 4:
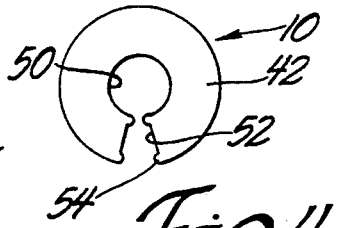
FIG. 4 is an enlarged end view of the other end of the electric connector plug retainer.
Figure 5:
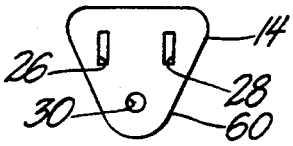
FIG. 5 is an end view of a female electric plug.
Figure 6:
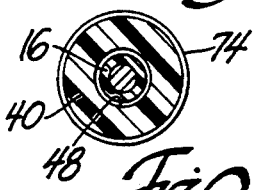
FIG. 6 is a sectional view taken along line 6—6 in FIG. 2.
Figure 7:
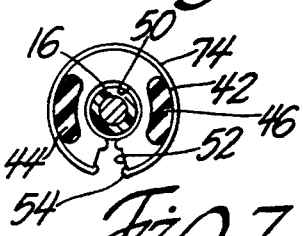
FIG. 7 is a sectional view taken along line 7—7 in FIG. 2.

The electric connector plug retainer 10 is placed in position to retain a connection between a male electric plug 12 and a female electric plug 14 by sliding the first ring section 40 along the cable 16 and into contact with the rear wall 32 of the male electric plug 12. The elongated elastic members 44 and 46 are positioned adjacent to the sides 60 and 62 of the male plug 12 and the female plug 14 and stretched until the second ring section 42 is adjacent to the cable 18 and clears the rear wall 36 of the female electric plug 14. Flanges 72 and 74 are provided on the first ring section 40 and the second ring section 42 to facilitate manual grasping of the ring sections and stretching of the elongated elastic members 44 and 46. The cable 18 is then forced through the slit 52 in the second ring section 42 and into the aperture 50. The elongated elastic members 44 and 46 contract until the second ring section 42 contacts the rear wall 36 of the female electric plug 14. The elongated elastic members 44 and 46 exert a force on the male electric plug 12 and the female electric plug 14 which biases the two electric plugs toward each other and maintains engagement between the terminals 20, 22, and 24 and the terminal receptacles 26, 28, and 30. To disconnect a male electric plug 12 from a female electric plug 14 the first ring section 40 is separated from the second ring section 42 and the cable 18 is moved laterally out of the central aperture 50 and through the slit 52. The elongated elastic members 44 and 46 are then moved away from the sides 60 and 62 and the first ring section 40 is slid along the cable 16 and away from the rear wall 32 of the male electric plug 12. After the first ring section 40 has moved away from the male plug 12 a sufficient distance, the cable 16 can be forced through the slit 54 and into the aperture 50 to store the electric connector plug retainer 10, as shown in FIG. 2, until needed for future use. The male electric plug 12 can be disengaged from the female electric plug 14 after they are released by the electric connector plug retainer 10.

The elongated elastic members 44 and 46 have sufficient resiliency to retain male electric plug 12 and female electric plug 14 in engagement with each other. If the combined size of the male electric plug 12 and the female electric plug 14 is small and the elongated elastic members 44 and 46 exert only a small force urging the female electric plug 14 and the male electric plug 12 toward full engagement with each other, an electric connector plug retainer 10 with shorter elongated elastic members will be required. If the elongated elastic members 44 and 46 are stretched close to or beyond their limit of expansion when they are stretched sufficiently to receive and hold a male electric plug 12 and a female electric plug 14 in engagement with each other, it will be necessary to employ an electric connector plug retainer 10 with longer elongated elastic members.

The force exerted by the elongated elastic members 44 and 46, to bias a male plug 12 and female plug 14 toward full engagement with each other and to maintain full engagement, can be varied by changing the cross section area of the elongated elastic members. The larger the cross sectional area of the elongated elastic members 44 and 46, the more force they will exert on a male and female plug when stretched a given portion of their length. An electric plug retainer 10 used with a heavy industrial electric cable 16 or 18 may therefore have elongated elastic members 44 and 46 with a larger cross section area than an electric plug retainer used with a light duty or capacity electric cable.

The number of elongated elastic members 44 and 46 may be changed. Additional elongated elastic members 44 and 46 could increase the force exerted on a male electric plug 12 and a female electric plug 14 to maintain engagement between them. Additional elongated elastic members 44 and 46 may also make it easier to drag a male and female electric plug, that are engaged with each other, along a rough surface or through obstructions. With some electric plugs, a single elongated elastic member 44 or 46 may be sufficient.

The employment of one ring section 40 without a slit 52 ensures that the electric connector plug retainer 10 remains attached to a particular electric plug 12 or 14 and that the plug retainer is available for use with that particular electric plug.

Figure 8:
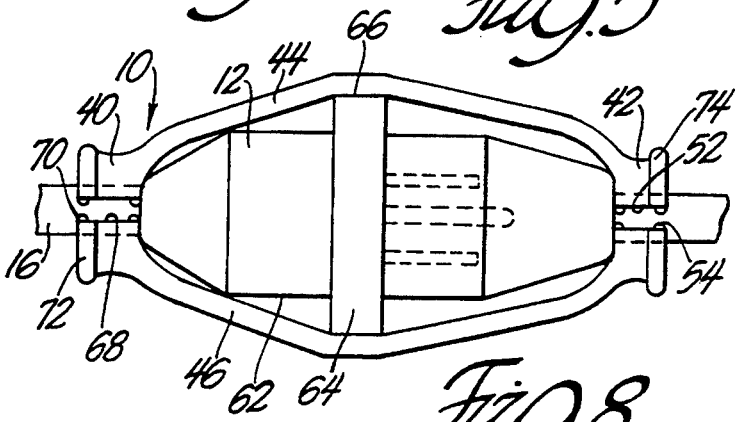
FIG. 8 is a bottom view similar to FIG. 1 with a large diameter electric plug.

A slit 68 can be provided in the first ring section 40 in addition to the slit 52 in the second ring section 42, as shown in FIG. 8, if desired. By providing a slit 68 in the first ring section 40 as well as the slit 52 in the second ring section 42, it is not necessary to disconnect a cable 16 from a machine or an electrical plug 12 to insert the cable 16 through the aperture 48. It is also possible to move an electric connector plug retainer 10 from one pair of cables 16 and 18 and cooperating plugs 12 and 14 to another pair of cables and plugs quickly and without tools. The slit 68 can be provided with tabs 70 like the tabs 54 in the slit 52 to facilitate the passage of an electric cable 16 through the slit.

As stated above, the first ring section 40, the second ring section 42, and the two elongated elastic members 44 and 46 are made from the same material and as one integral piece. By making the first ring section 40 and the second ring section 42 with large cross section areas, these sections can have sufficient rigidity to hold the cables 16 and 18. However, if desired, the first ring section 40 and the second ring section 42 can be molded from a thermoplastic that is more rigid and has less resilience than the elongated elastic members 44 and 46. It is possible to injection mold electric connector plug retainers 10 using multiple resins simultaneously. The first and second ring sections 40 and 42 can be one relatively stiff resin with moderate elasticity and the elongated elastic members 44 and 46 can be another resin with high elasticity. It is also possible to attach thermoplastic parts to each other by a welding procedure. The first ring section 40 and the second ring section 42 could be formed separately and then connected to each other by separate elongated elastic members with their ends attached to the ring sections by welding.

The female electric plug 12 shown in FIG. 8 has an integral ring 64 with a side surface 66 that is substantially larger in diameter than the side surface 62 of the male electric plug. The elongated elastic members 44 and 46 pass around the side surface 66 to accommodate the electric plug 12 with the integral ring 64.

Preferred embodiments of the invention have been described in detail, but are examples only and the invention is not restricted thereto. It will be easily understood by those skilled in the art that modifications and variations can easily be made within the scope of this invention.

I claim:

1. An electric connector plug retainer in combination with a male electric plug and a female electric plug wherein said male electric plug includes a male rear wall, a male front wall, male side walls, a male electric cable passing through the male rear wall and at least one male terminal extending axially from the male front wall; a female electric plug having a female front wall, a female rear wall, female side walls, and at least one female terminal receptacle in the female front wall in telescopic engagement with at least one male terminal of the male electrical plug for conducting electrical current, and a female cable extending through the female rear wall; said electrical connector plug retainer including a first ring section with an aperture which the male electrical cable passes through, a radially extending male electric plug rear wall contact surface on the first ring section, a second ring section with an aperture which the female electric cable passes through, a radially extending female electric plug rear wall contact surface on the second ring section, at least one elastic member integral with the first ring section and the second ring section which axially biases the male electric plug rear wall contact surface into continuous contact with the male rear wall and biases the female electric plug rear wall contact surface into continuous contact with the female rear wall, the male electrical plug and the female electric plug having a combined axial length between the male rear wall and the female rear wall, when the at least one male terminal is in telescopic engagement with the at least one female terminal receptacle, that exceeds the axial distance between the first and second ring sections when the at least one elastic member is in an unstretched state, the male rear wall of the male electric plug and the female rear wall of the female electric plug axially separating the first ring section and the second ring section and elongating the at least one elastic member when the at least one male terminal is telescopically received in the at least one female terminal receptacle and the male front wall is in contact with the female front wall, and a slit in one of said first or second ring sections for the lateral passage of the cable integral with the male or female electrical plug into and out of the first or second ring section aperture.

2. An electric connector plug retainer as set forth in claim 1 including two of said elastic members each of which is integral with the first ring section and the second ring section.

3. An electric connector plug retainer as set forth in claim 2 including a slit in an other of said first or second ring sections for the lateral passage of a cable into and out of said aperture through the other of said first or second ring sections.

4. An electric connector plug retainer as set forth in claim 1 including at least one tab on the one of said first or second ring section with said slit that resists lateral passage of a cable through said slit.

5. An electric connector plug retainer as set forth in claim 3 including at least one tab on the first ring section that resists lateral passage of the male cable through the slit in the first ring section; and at least one tab on the second ring section that resists lateral passage of the female cable through the slit in the second ring section.

6. For use with an axially telescopically engaged male and female electric connector plugs, an electric connector plug retainer including a first ring section with a cable aperture; a second ring section with a cable aperture; at least two elongated elastic members each of which is integral with the first and second ring sections and has a length when unstretched that provides less axial space between the first and second ring sections than is required to received electric connector plugs that are to be retained in engagement and wherein the at least two elongated elastic members are operable to elongate in response to force and allow separation of the first ring section from the second ring section and insertion of engaged electric connector plugs between the first and second ring sections and between the at least two elongated elastic members, and achieve axial bias of male and female electric connector plugs when said force elongating the at least two elastic members for insertion of male and female electric connector plugs is released; and a slit in said second ring section for the lateral passage of a cable into and out of said cable aperture through the second ring section.

7. An electric connector plug retainer as set forth in claim 6 including a slit in said first ring section for the lateral passage of a cable into and out of said cable aperture through the first ring section.

8. An electric connector plug retainer as set forth in claim 6 wherein the retainer is molded thermoplastic rubber.

9. An electric connector plug retainer as set forth in claim 8 including at least one tab integral with the second ring section and extending at least part way across said slit for inhibiting lateral passage of a cable through the slit and out of the cable aperture through the second ring section.

10. An electric connector plug retainer as set forth in claim 9 including a slit in said first ring section for the lateral passage of a cable into and out of said cable aperture through the first ring section; and at least one tab integral with the first ring section and extending at least part way across said slit for inhibiting lateral passage of a cable through the slit in the first ring section and out of the cable aperture through the first ring section.

* * * * *